United States Patent [19]

Jackson

[11] 4,311,210

[45] Jan. 19, 1982

[54] MULTI-PURPOSE LADDER ATTACHMENT

[76] Inventor: Jacob J. Jackson, 177 Main St., Tonawanda, N.Y. 14150

[21] Appl. No.: 195,494

[22] Filed: Oct. 9, 1980

[51] Int. Cl.[3] ..... E06C 7/44; E06C 7/48

[52] U.S. Cl. ..... 182/214; 182/20; 182/107; 182/204

[58] Field of Search ..... 182/214, 206, 204, 107, 182/108, 20; 248/210, 238, 235

[56] References Cited

U.S. PATENT DOCUMENTS

| | | | |
|---|---|---|---|
| 2,177,677 | 10/1939 | Staben | 182/214 |
| 2,256,452 | 9/1941 | Marshall | 182/214 |
| 2,316,723 | 4/1943 | Sorenson | 182/206 |
| 2,327,317 | 8/1943 | Randall | 182/214 |
| 2,448,716 | 9/1948 | Hurd | 182/206 |
| 2,803,389 | 8/1957 | Munson | 182/214 |
| 3,459,277 | 8/1969 | Frederick | 182/214 |
| 3,715,012 | 2/1973 | Perry | 182/214 |
| 4,069,893 | 1/1978 | Blackstone | 182/204 |

*Primary Examiner*—Reinaldo P. Machado
*Attorney, Agent, or Firm*—D. Paul Weaver

[57] ABSTRACT

A multi-purpose attachment for ladders enhances the safety and convenience of a ladder. A basic attachment unit is adjustable along ladder side rails and can be locked in any selected position. The basic unit contains fittings which allow the ready attachment and locking of gutter, roof and ladder side rail attachment components all held securely by set screws.

6 Claims, 6 Drawing Figures

FIG. 1a
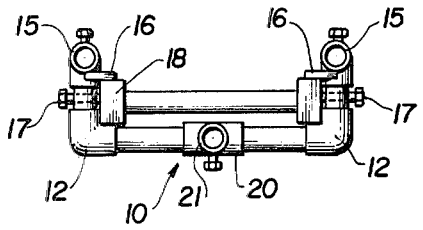
FIG. 2
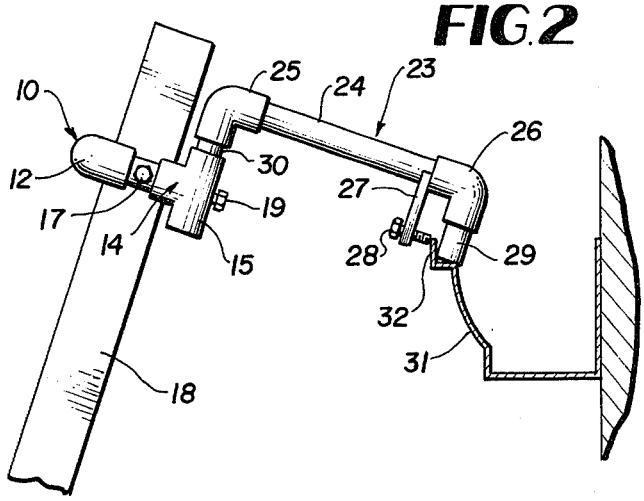
FIG. 3
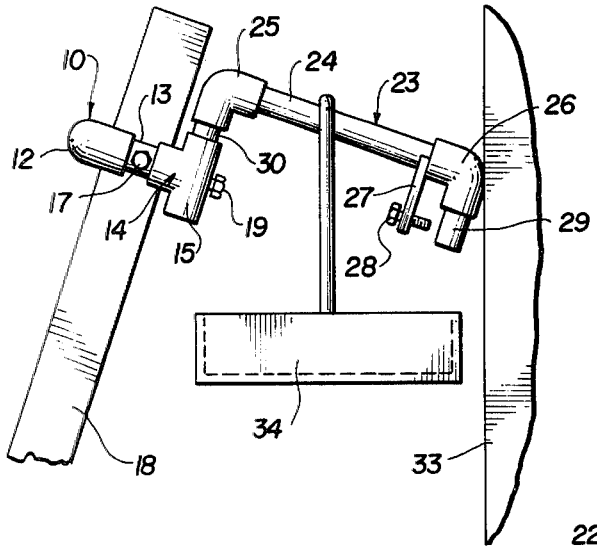
FIG. 4
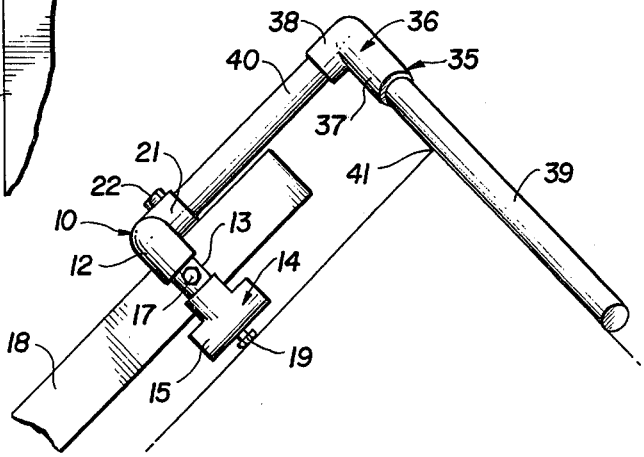
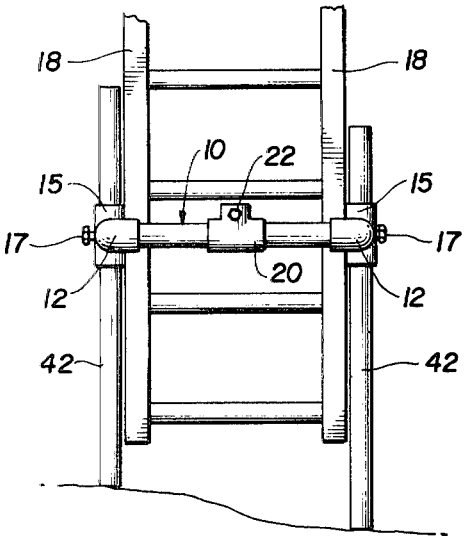
FIG. 5

MULTI-PURPOSE LADDER ATTACHMENT

BACKGROUND OF THE INVENTION

Numerous ladder supporting attachments and rests are known in the prior art. These attachments vary widely in construction and cost, and generally speaking are single purpose attachments such as devices to stabilize a ladder while resting against a pole or tree or to provide a desired stand-off distance between a ladder and a building wall or roof.

The present invention has for its object to provide a multi-purpose ladder attachment of greatly simplified construction and minimized cost which can be applied to any ladder for adapting the ladder to engage a rain gutter with stability, a pitched roof or a building side wall. A single mounting unit for the various attachment components mounts adjustably and lockingly on the ladder side rails and includes sockets for the various components equipped with locking set screws.

Other features and advantages of the invention will become apparent during the course of the following detailed description.

BRIEF DESCRIPTION OF THE DRAWINGS

FIG. 1A is a plan view of the attachment with parts omitted.

FIG. 2 is a fragmentary side elevation of the ladder attachment showing the use of gutter-engaging components.

FIG. 3 is a similar view showing the same components engaging a building side wall and supporting a container.

FIG. 4 is a similar view showing a roof-engaging component.

FIG. 5 is a front elevation of the attachment showing ladder side rail extensions.

DETAILED DESCRIPTION

Figure 1:
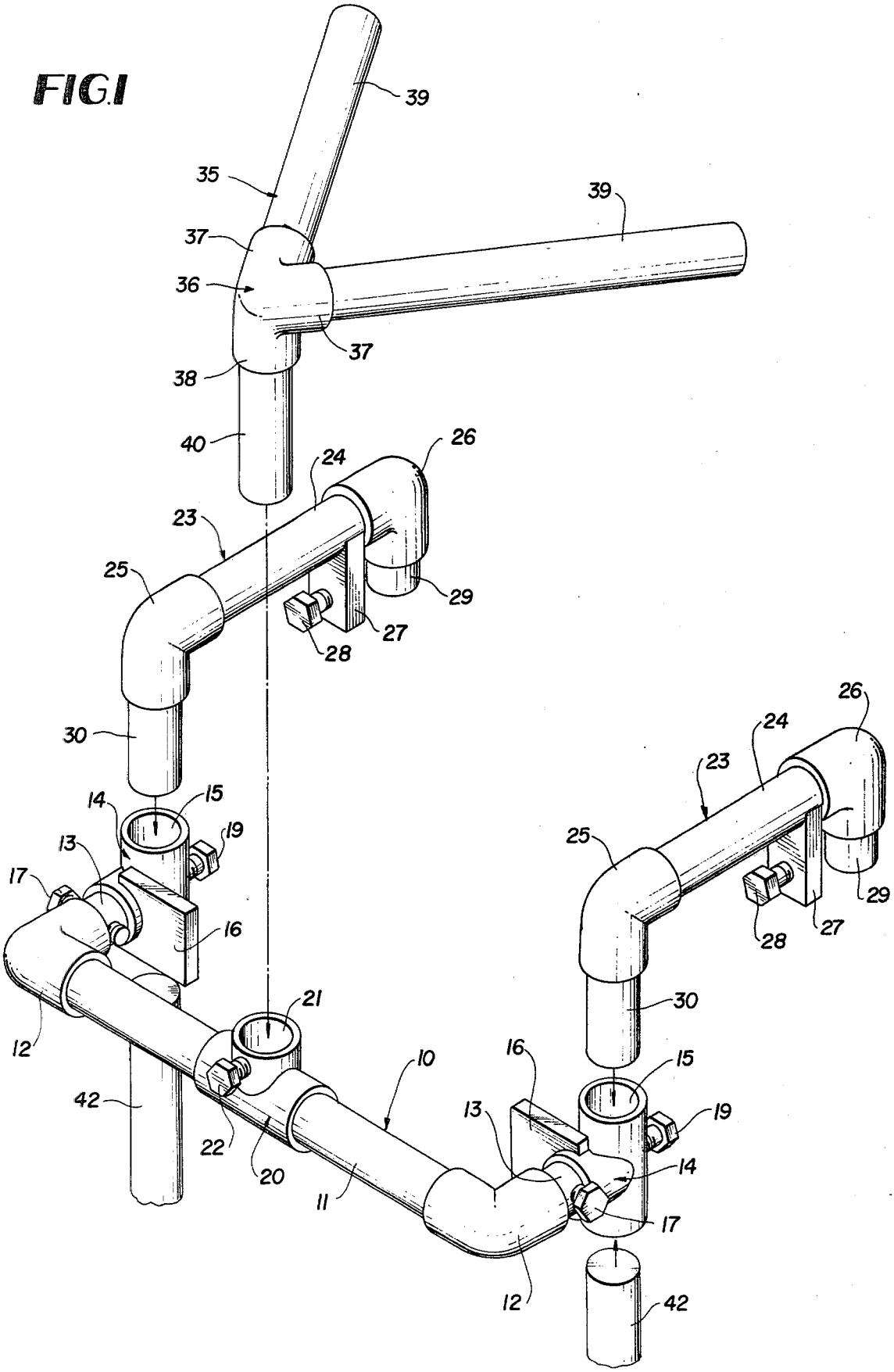
FIG. 1 is a partly exploded perspective view of a multi-purpose ladder attachment according to the invention.

Referring to the drawings in detail wherein like numerals designate like parts, a multi-purpose ladder attachment shown in its entirety in FIG. 1 comprises a basic attachment or mounting unit 10 consisting of a pipe section 11 having right angular elbows 12 fixed to its opposite ends and projecting forwardly thereof in a common plane during usage. Short pipe sections 13 rigid with the elbows 12 extend forwardly of the elbows and carry T-couplings 14 fixed thereto, the T-couplings including upright open-ended sleeves 15 projecting above and below the plane common to the elements 11, 12 and 13. Locator plates 16 are fixed on the inner sides of T-couplings 14 in spaced parallel relationship to the pipe section 11. Clamping set screws 17 are provided on the short pipe sections 13 across the axes of the ladder and parallel to the axis of pipe section 11. These set screws 17 are approximately midway between the locator plates 16 and the pipe section 11.

As shown in FIG. 1A, the side rails 18 of the ladder are received between the pipe section 11 and locator plates 16 with the two set screws 17 bearing on the outer faces of the ladder side rails to lock the unit 10 securely thereto at any location along the ladder side rail. The construction is such that the basis mounting unit 10 can be quickly adjusted along the side rails 18 to any chosen location and securely locked merely by tightening the two screws 17.

The upright axis sleeves 15 are also equipped with cross axis set screws 19, for a purpose to be described. Midway between the elbows 12, the pipe section 11 has a T-coupling 20 fixed therein including an upright axis sleeve 21 carrying a locking set screw 22, whose purpose will be described. This completes the construction of the basic mounting unit 10 which is common to the various attachment components, now to be described.

Among the attachment components are a pair of adapter arms 23, FIGS. 1, 2 and 3, each including a pipe section 24 and rear and forward elbows 25 and 26 fixed thereto. Locator plates 27 carrying set screws 28 are fixed to the lower sides of pipe sections 24 immediately inwardly of forward elbows 26 and parallel to the vertical depending short pipe inserts 29 thereof. Somewhat longer parallel depending pipe inserts 30 fixed in the elbows 25 are adapted to enter the bores of the sleeves 15 and to be locked therein securely by the two set screws 19. This enables the arms 23 to extend forwardly of the basic unit 10 at right angles thereto as depicted in FIGS. 2 and 3.

With respect to FIG. 2, the ladder attachment is utilizing the arms 23 to engage a rain gutter 31 in a safe and secure manner while providing suitable stand-off space between the ladder and the gutter. This stand-off space can be varied by changing the angles of the arms 23 within the sleeves 15. A stable connection between the gutter 31 and ladder is achieved by placing the pipe inserts 29 interiorly of the top gutter flange 32 and utilizing the set screws 28 to clamp this flange securely to the inserts 29, FIG. 2.

In FIG. 3, the attachment arms 23 have their forward elbows 26 resting against a building side wall 33 to provide an adjustable stand-off space for the ladder. A tool or nail container 34, or the like, can now be suspended from one of the arms 23 conveniently between the ladder and building side wall.

FIG. 4 illustrates the use of the basic unit 10 with a roof peak attachment or stabilizer unit 35. This unit comprises a three-way elbow 36 having forward divergent sleeves 37 and a single descending sleeve 38 at right angles thereto. Divergent pipe arms 39 are fixed within sleeve 37 and a pipe insert 40 is similarly fixed in the sleeve 38 and is adapted to enter the bore of upright sleeve 21 and be locked therein by set screw 22. As shown in FIG. 4, the pipe arms 39 engage the far side of the sloping roof beyond its peak or gable 41 while the ladder and attached unit 10 rest on the near side of the roof. The arrangement enables the ladder to be used safely on any peaked roof.

FIG. 5 shows a further capability of the ladder attachment wherein the basic mounting unit 10 is adjusted to a location near the lower end of the ladder and locked to the side rails 18 by the set screws 17. A feature of the unit 10 is that it does not interfere with the rung structure of the ladder and therefore can be freely adjusted to any point along the ladder and locked in place.

In FIG. 5, a pair of ladder side rail extensions 42 or bars are being utilized to support the ladder on non-level ground. These same two extensions may be utilized to increase the length of the ladder on level ground or on any support surface. The extensions 42, which may be pipes, are received in the bores of upright sleeves 15 and are locked by set screws 19 in any chosen adjusted positions, such as the positions of FIG. 5.

It will now be appreciated that the multi-purpose ladder attachment according to the invention is not only versatile but simple and sturdy in construction and highly convenient to use. The only tool required is a simple wrench to tighten the set screws 17, 19, 22 and 28 which are all of the same size for further convenience. If eye screws are employed, the ladder can be tightened by a nail or rod and therefore no tool is required to mount and adjust the multi-purpose attachment. The safety of the attachment can be enhanced by providing on all building contact surfaces a non-slip surface, such as a rubber pad.

A safety belt for the user of the ladder may be included to free the hands of the user while the ladder is being stabilized and held by the described attachment. Anchoring hooks for the safety belt, not shown, can be placed in the ladder side rails at appropriate levels.

The attachment 35 having the divergent arms 39 is also useful in stabilizing the ladder against a tree trunk or pole, not shown.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A multi-purpose ladder attachment comprising a basic mounting unit including a cross member spanning a ladder transversely during use and having means for clamping said unit to the opposite side rails of a ladder, said unit having a pair of upright axis sleeves near its opposite sides and an upright axis sleeve near its center, said sleeves having adjustable locking elements thereon, a pair of arm assemblies engageable in said pair of upright axis sleeves and being rotatable therein and lockable by said locking elements, ladder side rail extension members engageable adjustably in said side upright axis sleeves and being lockable therein by said locking elements, and an attachment for engaging a roof or pole including a depending member engageable and lockable in said upright sleeve near the center of said unit.

2. A multi-purpose ladder attachment as defined in claim 1, and said means for clamping said unit to the side rails of a ladder comprising a pair of locator plates on opposite sides of said unit in spaced parallel relationship to said cross member, and a pair of ladder side rail engaging set screws on the opposite sides of said unit between the locator plates and said cross member.

3. A multi-purpose ladder attachment as defined in claim 1, and said adjustable locking elements on said sleeves comprising set screws.

4. A multi-purpose ladder attachment as defined in claim 1, and adjustable clamping means on said arm assemblies operable to secure the arm assemblies to a rain gutter or the like.

5. A multi-purpose ladder attachment as defined in claim 4, and said clamping means comprising plates on the arm assemblies near their forward ends, set screws carried by said plates, and extension elements on the arm assemblies at their forward ends in spaced opposed relationship to the last-named set screws.

6. A multi-purpose ladder attachment as defined in claim 1, and said attachment for engaging a roof or pole further including a pair of divergent support members disposed in a plane substantially at right angles to said depending member, and a three-way elbow coupled with said divergent and depending members to form a rigid unit.

* * * * *